United States Patent [19]

Lalick

[11] Patent Number: 4,900,021

[45] Date of Patent: Feb. 13, 1990

[54] POCKET INSERT FOR POOL TABLE ASSEMBLY

[76] Inventor: Michael J. Lalick, 3700 W. 97th St., Evergreen Park, Ill. 60642

[21] Appl. No.: 284,297

[22] Filed: Dec. 14, 1988

[51] Int. Cl.[4] ..... A63D 15/00

[52] U.S. Cl. ..... 273/12

[58] Field of Search ..... 273/126 R, 12, 123 R, 273/3 C

[56] References Cited

U.S. PATENT DOCUMENTS

| | | | |
|---|---|---|---|
| 370,224 | 9/1887 | Wheeler | 273/123 R |
| 602,179 | 4/1898 | Haskell | 273/123 R |
| 3,138,387 | 6/1964 | Michel et al. . | |
| 3,610,618 | 10/1971 | Wiggins | 273/12 |
| 3,881,725 | 6/1975 | Rubalcava | 273/12 |

FOREIGN PATENT DOCUMENTS

| | | | |
|---|---|---|---|
| 4815 | 2/1898 | United Kingdom | 273/12 |

*Primary Examiner*—T. Brown

*Attorney, Agent, or Firm*—Richard Bushnell

[57] ABSTRACT

A pocket structure for assembly between two adjacent rail members of a pool table comprising a pocket defining insert having non-circular pin means extending from opposite ends thereof that fit and bind in apertures in the rail members to snugly secure them together in the desired position when the rail members are secured to a pool table frame.

10 Claims, 2 Drawing Sheets

POCKET INSERT FOR POOL TABLE ASSEMBLY

BACKGROUND OF THE INVENTION

This invention relates to a structure used for assembling rail members together to form a pool table.

In the past, a pool table has included a part called an insert or iron which is assembled between two adjacent rail members of a pool table. The iron is usually enclosed in a molded decorative cover and a pocket is secured to the table beneath the iron.

Currently, the pocket insert has included opposite end pins which are inserted into mating holes in the ends of the adjacent rail members. In order to hold the pins securely in the mating holes, it is necessary to drill and tap transverse apertures in the pins. These apertures will line up with apertures which have been drilled in the bottom surfaces of the rail members for receiving screws. It is the current practice that the screws be inserted and the apertures drilled on the bottom side of the rail members for aesthetic reasons. Thus, it has been necessary to turn the rail members and insert upside down during assembly so that the screws can be inserted.

When the entire rectangular assembly has been completed, the assembly is turned right side up.

The resulting rectangular frame which must be turned right side up, requires the strength of two men to manipulate it.

SUMMARY OF THE INVENTION

An object of this invention is to provide a unique pocket insert which can be securely assembled with the rail members while the rectangular frame is right side up. Thus, the need for two men to turn over the frame has been eliminated.

Another object of the present invention is to provide a novel pocket structure that secures the rail members of a pool table without the need for separate fasteners. Consequently, the need for drilling apertures in the pin means and rail member is no longer required. This causes a significant reduction in the time and money needed to assemble a pool table.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in which like reference numerals identify like elements, and in which:

DETAILED DESCRIPTION OF THE INVENTION

Figure 1:
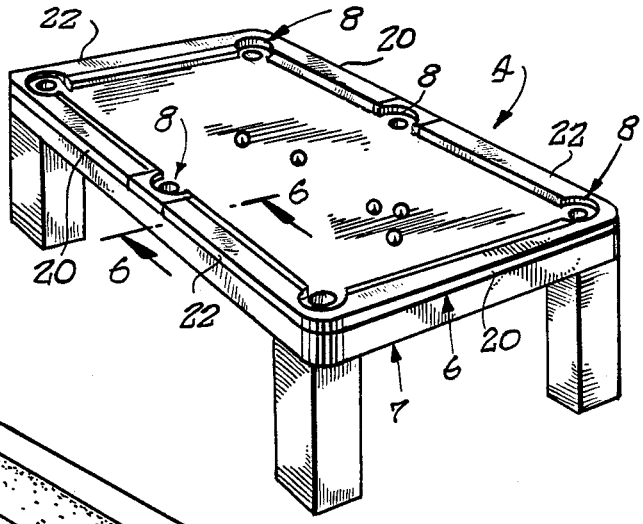
FIG. 1 is a perspective view of a pool table incorporating the present invention.

Referring now to FIG. 1, there is shown a pool table 4, which is comprised of a plurality of sets of adjacent rail members 20, 22, which fit together to form a rectangular frame 6 adapted to be positioned on a frame 7 of the table. Pocket inserts 8 constructed in accordance with the present invention are fitted between each pair of rail members 20, 22 in the manner described in detail below. The pocket inserts are provided at the sides and corners of the table and are essentially identical except for the differences in shape of the side and corner pockets.

Figure 2:
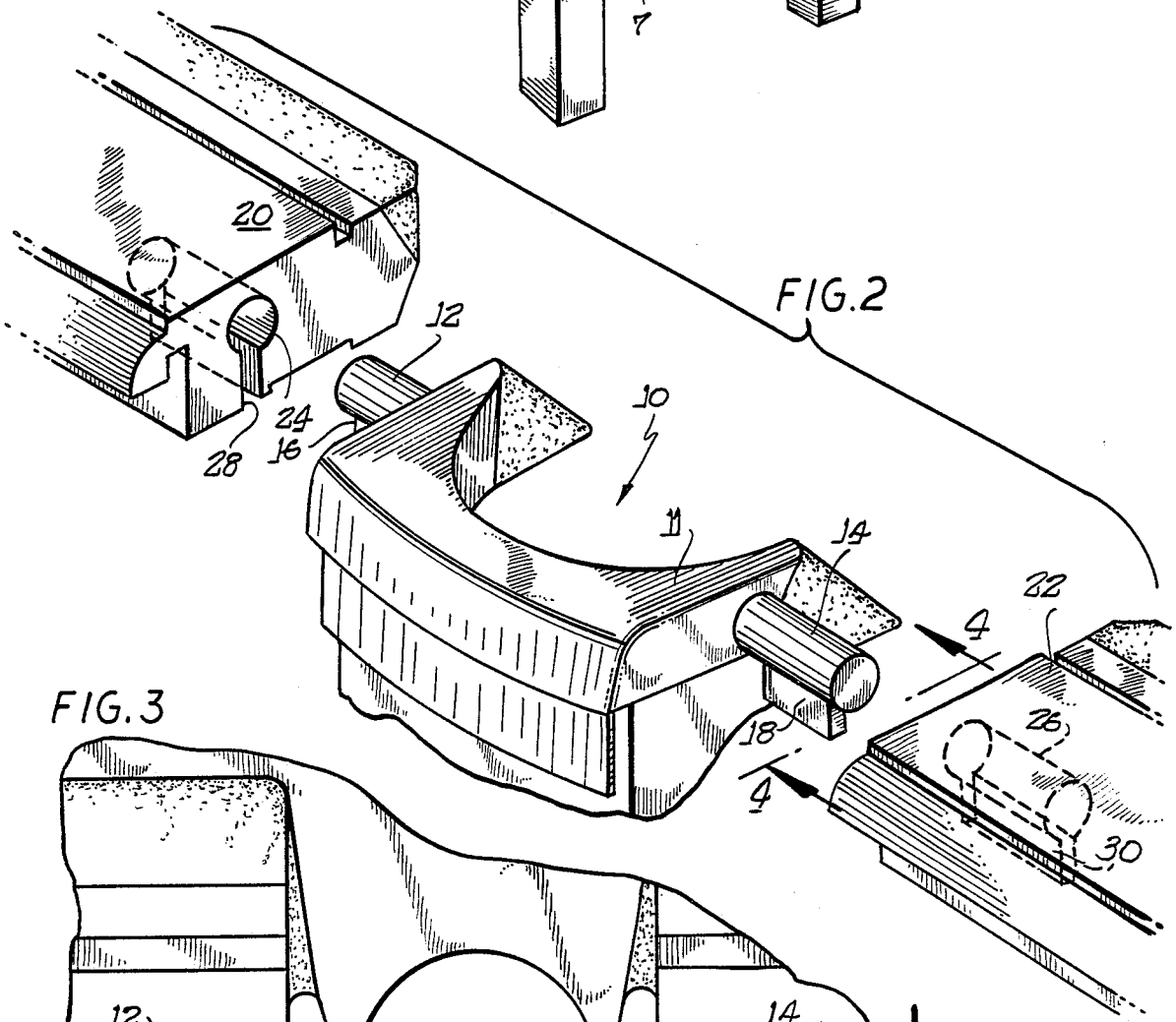
FIG. 2 is an exploded view, also in perspective, showing the manner of engagement between a pocket insert structure and the associated rail members.

FIG. 2 shows the innovative pocket insert 10 which comprises a body 11 of the desired shape and opposite laterally extending end pins 12 and 14 having flanges 16 and 18. Adjacent rail members 20 and 22 are formed with apertures or bores 24 and 26 respectively including intersecting slots 28 and 30 extending from bottom surfaces of the rail members for receiving the pins 12 and 14 respectively. The apertures 24 and 26 are slightly larger than the pin means 12 and 14 and the slots 28 and 30 are slightly wider than the flanges 16 and 18, but the dimensions are such as to provide a snug fit.

Figure 3:
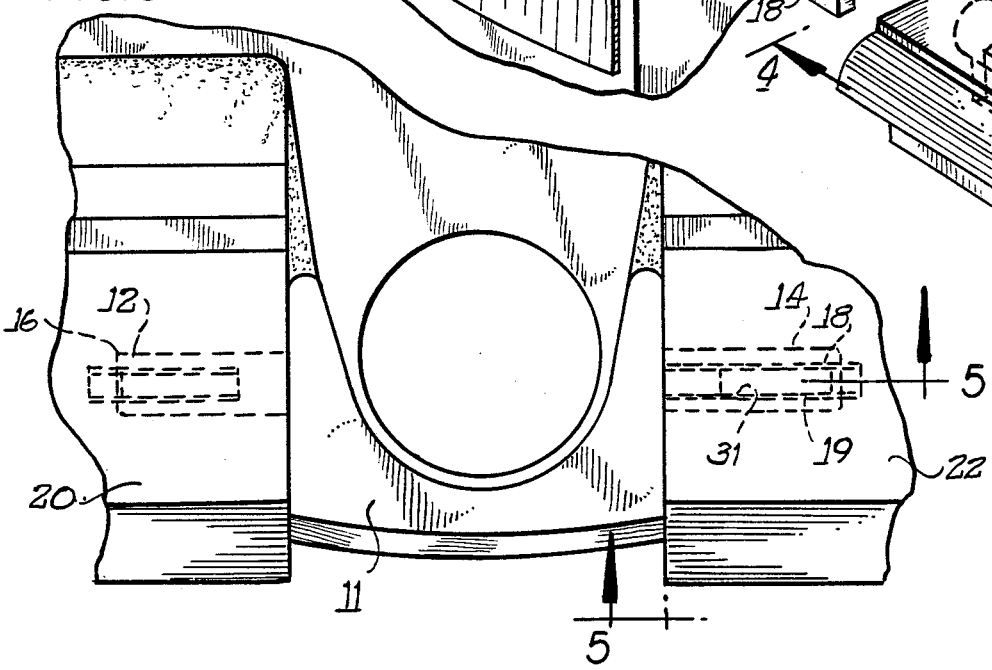
FIG. 3 is a plan view of the assembled pocket in place.
Figure 4:
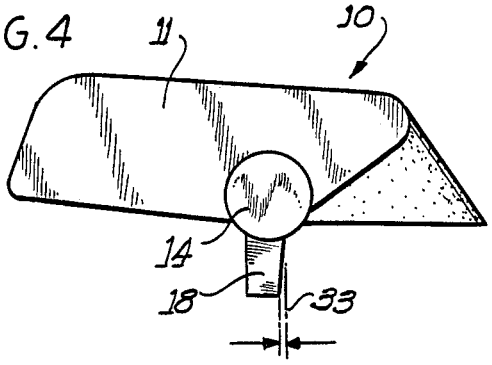
FIG. 4 is a side elevational view.

As best seen in FIGS. 3 and 4, each flange 16 and 18 is parallel to an upstanding plane which is inclined at a small angle 33 with the vertical axis. The slot 30 in the adjacent rail member 22 is vertical. Consequently, when the flange 18 is inserted into the slot 30, a side or interference or abutment surface 19 of the flange 18 will bind with a side or interference or abutment surface 31 of the slot 30 when the parts are finally secured to the frame 7 of the table as described below.

The friction caused by the interference of the flange 18 and the slot 30, at varying angles, will serve to securely bind the pocket insert 10 with respect to the rail member 22. The pin 12, flange 16, bore 24 and slot 28 are formed in the same manner to provide an interference fit for securing the pocket insert and rail member 20 with respect to each other.

Figure 6:
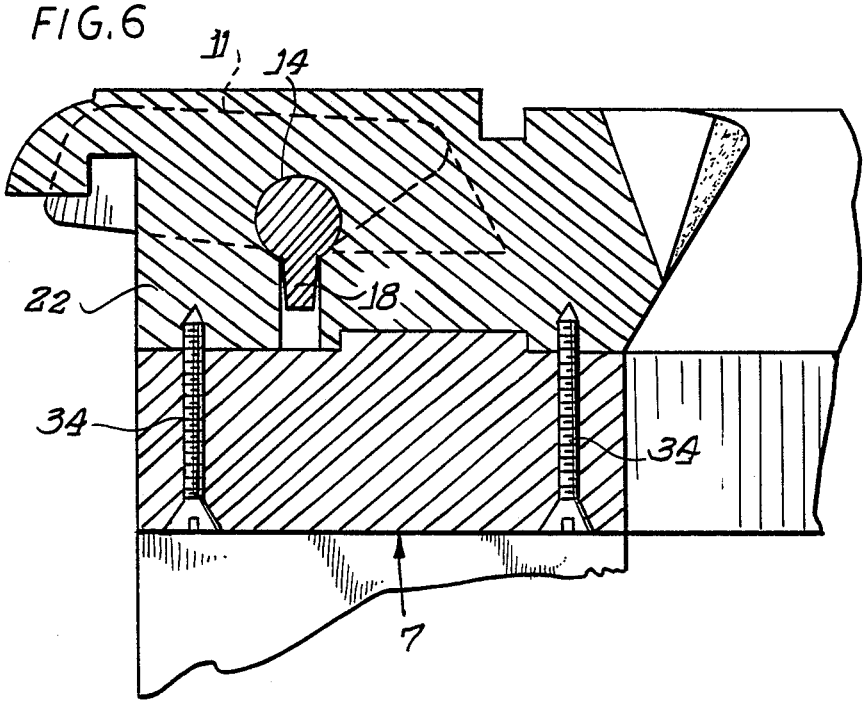
FIG. 6 is a sectional view taken along line 6—6 in FIG. 1.

During assembly of the structure of the present invention, the rail members may first be loosely arranged right side up and in a rectangular pattern on top of the table frame 7. Then the pocket inserts 10 may be easily assembled between each pair of adjacent rail members simply by inserting the pins 12 and 14 into the mating bores 24 and 26. Finally, the rail members are tightly drawn down against and secured with respect to the table frame 7 by a plurality of screws 34 as shown in FIG. 6. The screws 34 are spaced around the table frame in a known manner.

When the installation is complete, the interfering surfaces 19 and 31 of the pin means flanges and slot portions of the complementary openings in the rail members are urged into tight engagement to promote a rigid connection between the pocket insert and the rail members. It is to be understood that the pin means and complementary rail member openings could be formed with other non-circular or polygonal cross-sectional configurations for presenting interfering surfaces and locking the inserts 8 against rotation or turning around the axes of the pins. Furthermore, the axes of the pins 12 and 14 and of the bores 24 and 26 may be inclined slightly relative to each other to provide interfering surfaces along their length to further enlarge the rigidity of the final assembly. This modification is shown in FIG. 4.

As seen in FIGS. 3 and 6, in accordance with a further aspect of the invention, when the rail member 20 is finally firmly secured, the flanges 16 and 18 will be forced toward a vertical position. As a result, the body 11 of the pocket insert 10 will be inclined upward, as desired, two or three degrees relative to the horizontal plane of the rail members.

Figure 5:
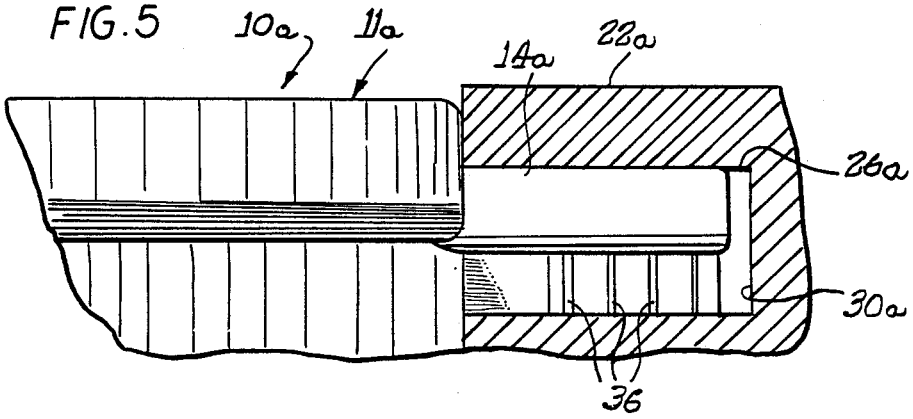
FIG. 5 is an enlarged fragmentary sectional view taken along line 5—5 in FIG. 3 showing a modified form of the invention.

As seen in FIG. 5, another embodiment of the invention in which elements corresponding to those described above are designated by the same reference numerals with the suffix "a" added. In this embodiment, the pin means 14*a* has ribs 36 provided on one side of its flange 18*a* for obtaining the desired thickness of the flange. The flange of the pin not shown corresponding to the pin 12 and flange 16 is also provided with the ribs 36. The use of the ribs 36 reduces the area of surface contact for facilitating initial insertion of the flanges 16*a* and 18*a* in the slots while still providing for an interference fit in the final assembly.

While particular embodiments of the invention have been shown and described in detail, many changes may be made without departing from the spirit and scope of the appended claims.

The invention is claimed as follows:

1. A pocket structure for assembly between adjacent horizontal rail members of a pool table comprising: a pocket insert including a body portion defining a pocket outline and opposed pin means extending laterally from opposite ends of said body portion for insertion into substantially conforming complementary aperture means axially formed in said adjacent rail members; said pin means comprising a shaft portion and planar abutment surfaces thereon projecting from said shaft portion for axial insertion into and engagement with said aperture means of said rail members for binding the pocket insert in a predetermined position with respect to the rail members.

2. A pocket structure according to claim 1, wherein said pin means is non-circular having said abutment surfaces positioned for binding engagement with an internal surface of said substantially conforming complementary aperture means of an adjacent rail member.

3. A pocket structure according to claim 1, wherein the pin means abutment surfaces are positioned for securing rail members relative said pocket insert and inclining the pocket insert with respect to said rail members.

4. A pocket structure according to claim 1, wherein said pin means are formed with axes which are angled with respect to the complementary aperture means for promoting binding of the pin means in the rail members.

5. A pocket structure for a pool table comprising: a pair of horizontal rail members, ends of said rail members having aperture means axially formed therein, and a pocket insert therebetween, said pocket insert having opposed pin means extending in opposite directions from said pocket insert and being free of enlargements for engagably laterally extending into said aperture means in the rail members, said aperture means substantially conforming to said pin means and comprising a combination of bores and slots laterally formed in said rail members, said bores and slots extending longitudinally of said rails, and said pin means includes portions which engage said aperture means and create a pin retaining interference fit; said rail members and pin means being formed such that when said pin means of said pocket insert are engagably inserted into said aperture means said pocket structure retainably binds the rail members and thereby secure said pocket insert with respect to said rail members.

6. A pocket structure according to claim 5, wherein said pin means comprises flange portions insertable into said slots.

7. A pocket structure for a pool table comprising: a pair of adjacent horizontal spaced apart rail members adapted to be secured to a pool table frame and having axially extending aperture means comprising bores in adjacent ends thereof and slots intersecting said ends and said bores, and a pocket insert including a pocket defining body portion between said ends of the rail members and pin means extending from opposite ends of the body portion, said pin means including first portions extending into said bores and second portions extending into said slots, said aperture means and said pin means including complementary abutment surfaces in binding engagement for securing said insert with respect to said rail members and for inclining said insert body portion with respect to the horizontal.

8. A pocket structure according to claim 7, wherein said bores have substantially horizontal axes and said slots intersect bottom surfaces of said rail members, said complementary abutment surfaces comprising opposing side surfaces of said slots and said second portions of said pin means.

9. A pocket structure according to claim 8, wherein said abutment surfaces also include opposing surfaces of said bores and said first portions of the pin means.

10. A pocket structure according to claim 10, wherein said first pin means portions have axes inclined with respect to the axes of said bores and said side surfaces of said second pin means portions are inclined with respect to the opposing side surfaces of said slots.

* * * * *